US008096352B2

(12) United States Patent
Ernst et al.

(10) Patent No.: US 8,096,352 B2
(45) Date of Patent: Jan. 17, 2012

(54) CENTRALIZER FOR TUBULAR ELEMENTS

(75) Inventors: Hugo Ernst, Buenos Aires (AR); Guillermo Dapino, Buenos Aires (AR); Matias Pereyra, Buenos Aires (AR)

(73) Assignee: Siderca S.A.I.C., Buenos Aires (AR)

( * ) Notice: Subject to any disclaimer, the term of this patent is extended or adjusted under 35 U.S.C. 154(b) by 322 days.

(21) Appl. No.: 12/425,143

(22) Filed: Apr. 16, 2009

(65) Prior Publication Data

US 2009/0260802 A1 Oct. 22, 2009

(30) Foreign Application Priority Data

Apr. 16, 2008 (AR) ..... P080101553

(51) Int. Cl.
*E21B 17/10* (2006.01)

(52) U.S. Cl. ..... 166/241.2; 166/241.6

(58) Field of Classification Search ..... 166/241.2, 166/241.3, 241.4, 241.6
See application file for complete search history.

(56) References Cited

U.S. PATENT DOCUMENTS

| | | | | |
|---|---|---|---|---|
| 3,963,075 | A | 6/1976 | Evans | |
| 4,793,412 | A | 12/1988 | Rivas et al. | |
| 5,115,863 | A | 5/1992 | Olinger | |
| 5,358,041 | A | 10/1994 | O'Hair | |
| 5,755,284 | A * | 5/1998 | Hart et al. | 166/241.4 |
| 6,016,866 | A | 1/2000 | Kaltwasser | |
| 6,152,223 | A | 11/2000 | Abdo et al. | |
| 6,484,803 | B1 | 11/2002 | Gremillion | |
| 6,516,877 | B2 * | 2/2003 | Terry | 166/241.2 |
| 6,585,043 | B1 | 7/2003 | Murray | |
| 6,830,102 | B2 * | 12/2004 | Kirk et al. | 166/241.6 |
| 7,140,432 | B2 | 11/2006 | Gremillion | |
| 7,156,171 | B2 | 1/2007 | Gremillion | |
| 7,182,131 | B2 | 2/2007 | Gremillion | |
| 7,918,274 | B2 * | 4/2011 | Thornton | 166/241.2 |
| 2006/0231250 | A1 | 10/2006 | Slack | |

FOREIGN PATENT DOCUMENTS

| | | |
|---|---|---|
| CA | 2101677 | 7/1993 |
| RU | 2211911 | 9/2003 |
| WO | WO 98/50669 | 11/1998 |

* cited by examiner

*Primary Examiner* — William P Neuder
(74) *Attorney, Agent, or Firm* — Knobbe Martens Olson & Bear, LLP

(57) ABSTRACT

A centralizer for tubular elements is provided which includes an inner part formed by a first material having high mechanical performance and chemical stability and an outer part arranged on said inner part, formed by a second material. The second material may be an autolubricating material. The second material may further possess a low coefficient of friction. The second material may additionally possess lower mechanical performance and chemical stability than the first material.

A method of manufacturing the centralizer is also provided, including steps of injecting the first material on a tubular element to form the inner part on the tubular element and injecting the second material to form the outer part on the formed inner part.

23 Claims, 2 Drawing Sheets

CENTRALIZER FOR TUBULAR ELEMENTS

CROSS-REFERENCE TO RELATED APPLICATIONS

This application claims priority to Argentinean Patent Application No. P08 01 01553, entitled "A CENTRALIZER FOR TUBULAR ELEMENTS MANUFACTURED FROM TWO MATERIALS AND A PROCESS OF MANUFACTURING SAID CENTRALIZER", filed Apr. 16, 2008, the entirety of which is hereby incorporated by reference.

BACKGROUND OF THE INVENTION

1. Field of the Invention

Embodiments of the present disclosure pertain to centralizers and, in particular, to a centralizer having a body formed from two materials, one arranged within an inner part of the body and one arranged in an outer part of the body.

2. Description of the Related Art

Currently available centralizers are manufactured from a single material, generally a plastic material. The material is injected on the tubular element to be centralized, more specifically on a both hollow and solid pumping rod. The material may be further arranged by employing a two-piece fitting joint or it assembly by other mechanisms.

In those cases where the material is injected on the tubular element, a centralizer is obtained that has a molecular framework and an attachment level to the tubular element that varies significantly on the basis of the injecting conditions. However, under normal production conditions, the molecular framework of the centralizer can be adjusted to be as crystalline as possible, increasing the attachment to the tubular element. Generally, either surface modification (such as sandblasting) or slot machining may be used for improving attachment of the centralizer to the tubular element.

When the centralizer is arranged by assembling multiple pieces, the attachment is much weaker than using injection. Even more, some additional insertions may be added, such as pivots, screws, etc. to allow for positioning of the parts. On the other hand, assembling centralizers is advantageous because they can be more easily fitted in either position which may be desired.

Regarding the material properties of these centralizers, the plastic is generally highly hard and resistant to deterioration and corrosion. Engineered polymers are those which meet the requirements to operate in oil wells. The most popular engineered polymers include polyphenylene sulfide (PPS), high temperature polyamides (PA), polyphthalamide (PPA), polyphenylene ether (PPE).

These engineered polymers may be further modified by aggregates such as glass, minerals, or aramid fibers. Ceramic enhancers may be employed for maintaining mechanical properties at high temperatures. While the base polymers provide chemical resistance during use, the enhancing elements provide resistance to creep ("creep resistance"). The resulting composite material improves the properties of the base polymer, which may be beneficial to ensure the expected performance in very hard environments.

Although these materials have shown excellent performance in aggressive environments, they are expensive and may cause deterioration of the metallic piece against which they move. For example, metallic damage due to the employment of a PPS centralizer in some oil wells has been reported. The presence of glass fibers as enhancer in the above mentioned centralizer has increased erosion and damage of the metallic surface, and has resulted in significant thickness reduction. Furthermore, long term contact with high temperature environments that also deteriorates the mechanical properties of these materials, resulting in detachment.

It may be assumed that each possibility of having a single material for manufacturing a centralizer has a clear disadvantage and a related problem as well, which in the end causes early extraction and replacement of the piece. Documents US 2006/231250, U.S. Pat. No. 6,585,043, WO 98/50669, CA 2101677, U.S. Pat. No. 3,963,075, RU 2211911, US 2005/0241822, US 2004/0112592, US 2003/0070803, U.S. Pat. Nos. 4,793,412, 7,156,171, 7,182,131, 7,140,432 and 6,484,803 disclose centralizers made from a single material, including rollers or blades.

From the forgoing, then, it may be understood that there is an ongoing need for improved centralizers.

SUMMARY OF THE INVENTION

Embodiments of the present disclosure present centralizers for use in centering tubular elements. The centralizers may be employed for centering the tubular elements in structures such as well bores and other pipe strings. Tubular elements may include solid and hollow mechanical pumping rods, where movement of the pipe string is alternately upwards and downwards. In alternative embodiments, the centralizers may be employed with tubular elements such as progressing cavity pump (PCP) type, where movement of the pipe string is rotative. The body of the centralizer is formed by two materials, one of them is arranged within the inner part of said body, and the other one within the outer part of said body.

In an embodiment, a centralizer for tubular elements is provided. The centralizer comprises an inner part formed by a first material having high mechanical performance and chemical stability. The centralizer further comprises an outer part arranged on said inner part formed by a second material. The second material is substantially autolubricating, possesses a low coefficient of friction; and further possesses lower mechanical performance and chemical stability than the first material.

In another embodiment, a process of manufacturing the centralizer is provided. The process comprises injecting a first material forming an inner part on a tubular element and injecting a second material on said formed inner part. The first material may comprise polyphenylene sulfide. The second material may comprise polyamide.

BRIEF DESCRIPTION OF THE DRAWINGS

Embodiments of the present disclosure may be better understood on the basis of the following drawings, namely.

DETAILED DESCRIPTION

Figure 1A:
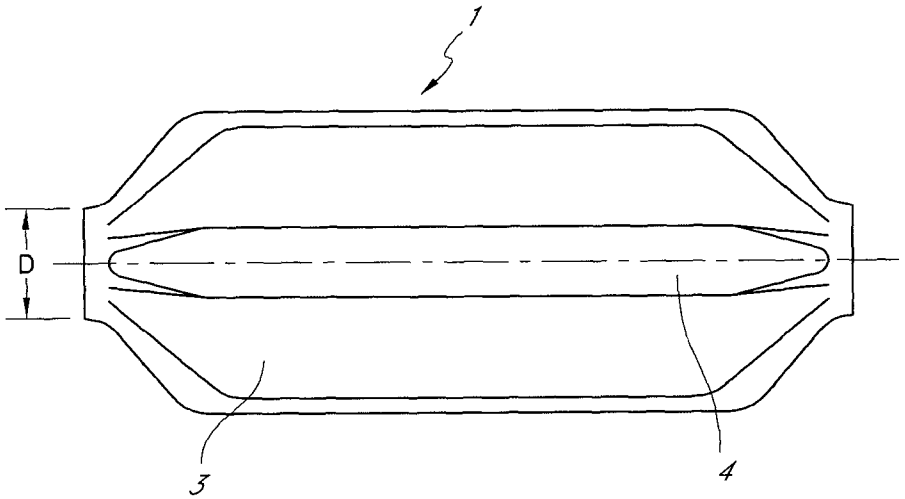
FIGS. 1A and 1B show, respectively, a side view and a front view of a substantially straight rotative centralizer of the invention.

In an embodiment, a two-material centralizer is disclosed. The two material centralizer comprises an inner part manufactured from a strong, rigid material with high detachment strength, and an outer part manufactured from an autolubricating, and non-erosive material with a low coefficient of friction.

In further embodiments, the centralizer may be manufactured by a double injection process. Firstly, the inner part may be injected. Then, the remaining volume may be filled with the outer material. Within the interface, no chemical attachment may be needed between both materials to allow the outer part rotate around the inner part when torque is applied. The possibility of rotating around a core may reduce the friction between the centralizer and the metallic surface. Additionally, the blades of the centralizer no longer move along a straight line during alternative movement of the centralizer but rather during contact with the whole inner tubular surface. Therefore, erosion of the metallic surface is not localized and total damage of the tubular piece is reduced.

The centralizer of the present invention further solves two important problems related to the performance of centralizers during operation: resistance to detachment of the tubular element and a low coefficient of friction, together with low deterioration and damage to the metallic piece.

Another advantage of embodiments of the presently disclosed centralizer is that the rotative outer part diminishes the strength detaching the centralizer. This is due to the fact that, even if the volume covered by the stronger material is lower than an eventual unique material centralizer, it does not substantially deteriorate the resistance to detachment.

Embodiments of the disclosed centralizer bear operation conditions with substantially no detachment of the tubular part to which it is attached, and with substantially no damage to the metallic surface to which it is in contact during movement.

The two-material centralizer also substantially reduces the torque applied to the interface between the centralizer and the tubular element to which it is attached. This can be reached through a rotative outer part, which rotates around the inner part.

The rotating movement has an additional advantage: the blades of the centralizer can continuously rotate, substantially inhibiting localized erosion of the metallic surface.

As a consequence, embodiments of the present disclosure provide a solution for the above mentioned problems, namely the usage of two materials, which may be formed by injection-casting of polymeric materials, one over the other. The geometries of both parts are compatible based on the fact that the outer part, in certain embodiments, may be allowed to rotate around the inner part. In further embodiments, the outer part may possess helicoidal blades. The material forming the inner part may possess a higher elastic modulus than that forming the outer part, as well as improved mechanical properties, even at high temperatures. The material forming the outer part may also possess a low coefficient of friction and may be auto-lubricating, providing a good interface for continuous operation in contact with the tubular element walls.

The rotative outer part may further allow for reduction of net torque, increasing the service life of the centralizer. In certain embodiments, the centralizer may rotate approximately 360° when in contact to the metallic surface, substantially reducing localized erosion and the damage borne by the metallic surface.

In an embodiment, the process of localizing the centralizer comprises injecting the inner material on the tubular element, where the inner material possesses high mechanical performance and chemical stability. An example of such a material may include, but is not limited to, PPS. Subsequently, the outer material is injected on the core. An example of the outer material may include, but is not limited to, polyamide, having a low friction index but with lower mechanical performance and chemical stability than the inner material.

In this manner, a PPS core may be formed, which may be useful as an anchor to prevent the polyamide from detaching from the axial position taken by the device within the tubular element. In both cases, the grip may be adjusted by means of a tightening effect on the plastic around the tubular element and the centralizer core. This effect may be achieved by the volumetric contraction of the materials upon cooling after the injection process.

In alternative embodiments, depending on the application, the outer material may not rotate around the core. For example, a plurality of locks may be positioned circumferentially, longitudinally, or a combination thereof, about the periphery of the inner part of the centralizer.

As a result, it is possible to manufacture centralizers meeting both options. In embodiments where the centralizer is designed to rotate, the first injection may be configured without locks. Such configurations may be advantageous under circumstances of elevated torque for which. In other embodiments where the centralizer is designed to be fixed, the first injection may be configured with locks.

In further embodiments, depending on the application of the pumping rod, two geometric types for centralizers may be defined. One of them is substantially straight, with longitudinal blades for the case of mechanical pumping rods. The other one may be substantially helicoidal, with helicoidal blades, for the PCP pumping rods, as previously described herein.

Figure 1B:
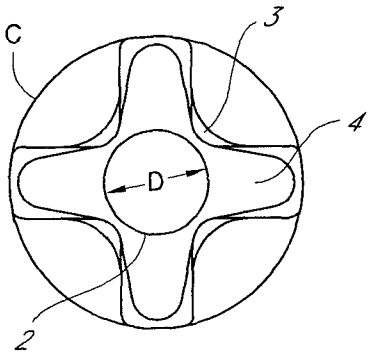

FIGS. 1A and 1B show a substantially straight, rotative centralizer 1 for mechanical pumping rods. The centralizer 1 comprises an inner part or core 2 manufactured from a strong, rigid material having high detachment strength and an outer part 3 manufactured from a material with a low coefficient of friction and which is substantially autolubricating and non-erosive. The inner diameter D of said inner part or core 2 is cooperative with that of the tubular element to be centralized. The outer part 3 further comprises longitudinally cast blades 4 contacting tubing C with a view to centralizing the tubular element. The tubing C may comprise a wall of a well bore, pipe string, or other structure in which the tubular element is to be centered within. Within the interface between said inner part 2 and outer part 3, there is substantially no chemical attachment, so that the outer part 3 can rotate around the inner part 2 when torque is applied.

Figure 2B:
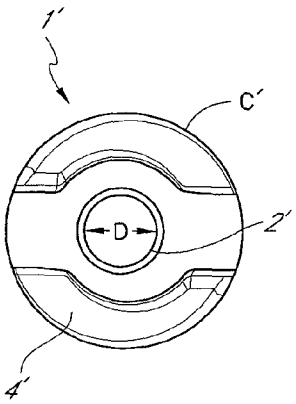
FIGS. 2A and 2B show, respectively, a side view and a front view of a substantially helicoidal rotative centralizer of the invention.
Figure 2A:
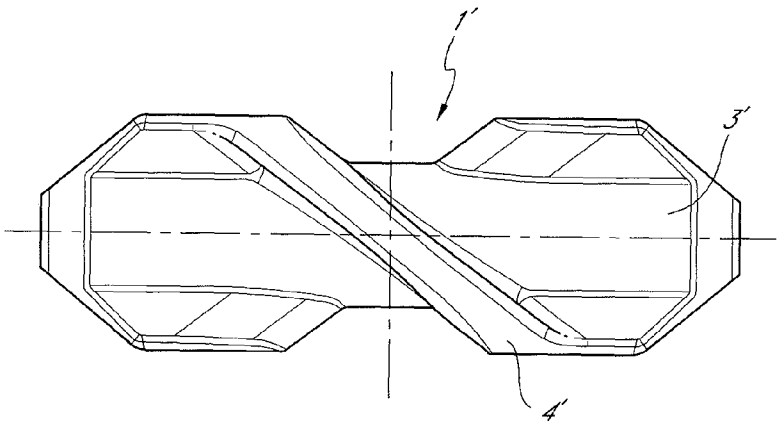

FIGS. 2A and 2B show a substantially helicoidal, rotative centralizer 1' for PCP pumping rods. The centralizer 1' comprises an inner part or core 2' manufactured from a strong, rigid material having high detachment strength and an outer part 3' manufactured from a material with a low coefficient of friction and which is substantially autolubricating and non-erosive. The inner diameter D' of said inner part or core 2 is cooperative with that of the tubular element to be centralized. Outer part 3' further comprises longitudinally cast blades 4' contacting tubing C' with a view to centralizing the tubular element. The tubing C' may comprise a wall of a well bore, pipe string, or other structure in which the tubular element is to be centered within. Within the interface between said inner part 2' and outer part 3' there is no chemical attachment whatsoever, so that the outer part 3' can rotate around the inner part 2' when torque is applied.

In embodiments where the tubular elements comprise mechanical pumping rods, where the pipe string has an upwards and downwards movement, the blades may be substantially longitudinal. In embodiments where the tubular elements comprise PCP pumping rods, and the pipe string has rotative movement, the blades may be helicoidal.

Figure 3B:
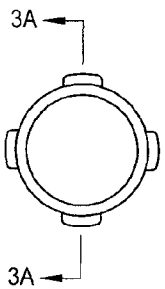
FIGS. 3A and 3B show, respectively, a side view and a front view of the core of a fixed centralizer of the invention including locks within the inner part thereof.
Figure 3A:
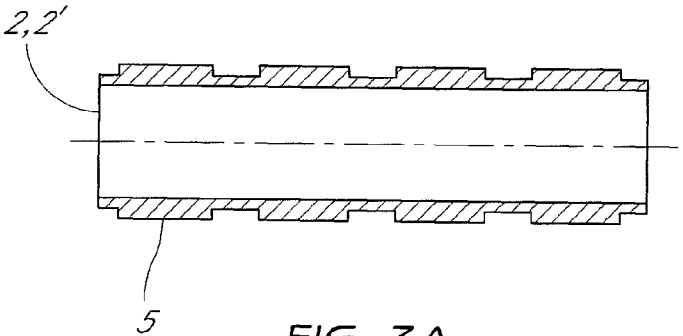

FIGS. 3A and 3B show in detail the inner part or core in an embodiment of a fixed centralizer. Examples of such inner parts or cores may include, for example, inner parts or cores 2 or 2' as discussed above. Within the periphery of the inner part 2, 2' a plurality of locks 5, of any kind of geometry may be included. The plurality of locks 5 may fulfill the function of substantially inhibiting the outer part (not shown) of the fixed centralizer from rotating around inner parts 2, 2'.

In an example, a selected number of locks may be arranged on the periphery of the inner part 2, 2'. The locks 5 may be arranged circumferentially, longitudinally, and combinations thereof. In a further example, approximately 16 substantially equispaced locks may be positioned both circumferentially and longitudinally on the periphery of the inner part 2,2', as illustrated on FIGS. 3A and 3B, having the same substantially prismatic configuration. In alternative embodiments, other kinds of geometry and/or arrangement of the locks may be employed, depending on the manufacturing criteria employed, being well-known to a person skilled in the art.

In an embodiment, the process of localization of a centralizer, such as centralizer 1 or 1' comprises of injecting, on the tubular element, the inner material forming the inner part or core 2, 2'. As discussed above, the inner material possesses high mechanical performance and chemical stability, for example PPS. Subsequently, the outer material is injected on said the inner part 2, 2' in order to form the outer part 3, 3'. The outer material comprises a material possessing a low friction index but lower mechanical performance and chemical stability than the inner material, for example polyamide.

Depending on the application of the pumping rod, in alternative embodiments, it may be desired that the outer part 3, 3' not rotate around the inner part 2, 2. Consequently, centralizers 1, 1' may be manufactured to meet both options.

In the case of applications involving elevated torque, it may be desired for the centralizer 1, 1' to be rotative. Thus, the inner part 2, 2' may be fabricated without locks 5 arranged on the periphery of the inner part 2, 2'.

In the case of applications where it is desired that the centralizer 1, 1' be fixed, the inner part 2, 2' may include substantially equispaced locks 5. The locks 5 may be arranged circumferentially and longitudinally arranged on the periphery of the inner part 2, 2'.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A centralizer for tubular elements comprising:
- an inner part formed from a first material having high mechanical performance and chemical stability;
- an outer part arranged on said inner part and formed from a second material;
- wherein said second material is substantially autolubricating; and
- wherein said second material further possesses a low coefficient of friction;
- wherein said second material possesses lower mechanical performance and chemical stability than said first material;
- wherein a plurality of locks are arranged on the periphery of said inner part so as to inhibit relative motion of the outer part with respect to the inner part.

2. The centralizer according to claim 1, wherein there is no chemical attachment on the interface between the inner part and outer part.

3. The centralizer according to claim 1, wherein said plurality of locks are arranged in a substantially equispaced fashion, both circumferentially and longitudinally on said periphery of said inner part.

4. The centralizer according to claim 1, wherein the inner diameter of said inner part is cooperative with that of the tubular element to be centralized.

5. The centralizer according to claim 4, wherein said outer part further comprises blades substantially contacting tubing of a well so as to center the tubular element with respect to the well.

6. The centralizer according to claim 5, wherein said blades are longitudinal for the case of mechanical pumping rods, wherein the tubing has an upwards and downwards movement.

7. The centralizer according to claim 5, wherein said blades are helicoidal, for the case of progressing cavity pump (PCP) pumping rods, and the tubing has a rotative movement.

8. The centralizer according to claim 1, wherein said tubular elements comprise at least one solid or hollow mechanical pumping rod.

9. A process of manufacturing a centralizer for tubular elements, said process comprising the following steps:
- injecting a first material forming an inner part on a tubular element; wherein the first material possesses high mechanical performance and chemical stability; and
- injecting a second material on said formed inner part;
- wherein said second material is substantially autolubricating, possesses a low coefficient of friction, and further possesses lower mechanical performance and chemical stability than said first material;
- wherein a plurality of locks are arranged on the periphery of said inner part.

10. The process according to claim 9, wherein said first material is a polymeric material having high mechanical performance and chemical stability.

11. The process according to claim 10, wherein the first material comprises polyphenylene sulfide (PPS).

12. The process according to claim 9, wherein said second material is a polymeric material having a low friction index but lower mechanical performance and chemical stability than the first material.

13. The process according to claim 9, wherein the second material comprises polyamide.

14. The process according to claim 9, wherein said plurality of locks are arranged in a substantially equispaced fashion both circumferentially and longitudinally on said periphery of said inner part.

15. The process according to claim 9, wherein said tubular element comprises at least one solid or hollow mechanical pumping rod.

16. A process of manufacturing a centralizer, said process comprising the following steps:
- injecting a first material forming an inner part on a tubular element; wherein first material possesses high mechanical performance and chemical stability; and
- injecting a second material on said formed inner part;
- wherein said second material is substantially autolubricating, possesses a low coefficient of friction, and further possesses lower mechanical performance and chemical stability than said first material;
- wherein said second material is a polymeric material.

17. The process of claim 16, wherein the second material comprises polyamide.

18. A process of manufacturing a centralizer, said process comprising the following steps:

injecting a first material forming an inner part on a tubular element; wherein said first material possesses high mechanical performance and chemical stability; and injecting a second material on said formed inner part;

wherein said second material is a plastic and is substantially autolubricating, possesses a low coefficient of friction, and further possesses lower mechanical performance and chemical stability than said first material;

wherein a grip between said inner part and said tubular element is adjusted by tightening of the second material around said tubular element and said inner part of the centralizer, resulting from the volumetric contraction of the materials upon cooling, after the injection process.

19. A centralizer for tubular elements comprising:

an inner part formed from a first polymeric material having a first elastic modulus, the inner part defining an inner diameter to cooperate with the tubular element to be centralized;

an outer part arranged on said inner part and formed from a second polymeric material having a second elastic modulus, the first elastic modulus being higher than the second elastic modulus;

wherein the outer part comprises a plurality of blades configured to contact a structure in which the tubular element is to be centered within.

20. The centralizer according to claim 19, wherein the first material comprises polyphenylene sulfide (PPS).

21. The centralizer according to claim 19, wherein the second material comprises a polyamide.

22. The centralizer according to claim 19, further comprising a plurality of locks arranged on a periphery of said inner part so as to inhibit relative motion of the outer part with respect to the inner part.

23. The centralizer according to claim 19, wherein the outer part is configured to rotate relative to the inner part.

* * * * *